US008250675B2

(12) United States Patent
Duncan

(10) Patent No.: US 8,250,675 B2
(45) Date of Patent: Aug. 28, 2012

(54) LEG GARMENT

(76) Inventor: Cynthia Duncan, Denver, CO (US)

( * ) Notice: Subject to any disclaimer, the term of this patent is extended or adjusted under 35 U.S.C. 154(b) by 0 days.

(21) Appl. No.: 11/682,202

(22) Filed: Mar. 5, 2007

(65) Prior Publication Data

US 2008/0216203 A1 Sep. 11, 2008

(51) Int. Cl.
*A41D 1/06* (2006.01)
*A41D 13/02* (2006.01)

(52) U.S. Cl. ..... 2/227; 2/79

(58) Field of Classification Search ..... 2/22, 23, 2/466, 919, 231, 79, 227, 467, 270, 232, 2/78.2, 408, 234, 76, 69.5
See application file for complete search history.

(56) References Cited

U.S. PATENT DOCUMENTS 1,512,171 A * 10/1924 Homling ..... 2/78.2
1,612,766 A * 12/1926 Levinson ..... 2/22
1,758,740 A * 5/1930 Gale ..... 2/78.2
1,861,383 A * 5/1932 Ficcio ..... 2/227
1,973,963 A * 9/1934 Nishimoto ..... 2/408
2,396,599 A * 3/1946 O'Brien ..... 2/408
3,800,330 A 4/1974 Bowcut
4,280,230 A * 7/1981 LaFleur ..... 2/408
4,389,733 A 6/1983 Boykins, Jr.
4,506,391 A 3/1985 Rodman
4,561,121 A 12/1985 Ehring et al.
4,604,761 A 8/1986 Wright
4,613,991 A 9/1986 Grover
4,651,355 A * 3/1987 White ..... 2/247
4,920,577 A 5/1990 Scharf
4,951,321 A * 8/1990 Mortensen et al. ..... 2/408
4,961,234 A 10/1990 Leibman
4,984,303 A 1/1991 Ross
5,033,124 A 7/1991 Bucalo et al.
5,038,408 A 8/1991 DeBaene
5,123,120 A 6/1992 Ross
5,271,101 A 12/1993 Speth et al.
5,295,267 A 3/1994 Galindo
5,418,978 A * 5/1995 Hochman ..... 2/69
5,539,926 A 7/1996 Mantos
5,551,091 A 9/1996 Tyndall
5,790,984 A 8/1998 Doubleday
5,794,267 A 8/1998 Wallace
5,896,581 A 4/1999 Wong
5,930,838 A 8/1999 Carter-Scott-Pomije
6,119,274 A 9/2000 Graham
6,192,522 B1 2/2001 Schreib
6,202,215 B1 3/2001 Sauter
6,338,164 B1 1/2002 Howard
6,557,175 B2 * 5/2003 Greenblatt ..... 2/69
6,611,964 B2 9/2003 Lipsett et al.
6,990,693 B2 1/2006 Reschewitz
2001/0004771 A1 6/2001 Chou
2003/0226197 A1 12/2003 Cramer
2005/0246819 A1 11/2005 Tucker
2006/0143800 A1 7/2006 Deffner

* cited by examiner

*Primary Examiner* — Alissa L Hoey
*Assistant Examiner* — Amber Anderson

(57) ABSTRACT

A leg garment comprising a garment insert having a first material, a front portion, an inseam portion, and a seat portion adapted to cover at least a portion of a wearer's right hip and a portion of a wearer's left hip. Included in the garment insert is a fastening system coupling the garment insert to a garment's leg section. The leg section comprises a second material and may have at least one hip extension and a waistband.

8 Claims, 4 Drawing Sheets

LEG GARMENT

FIELD OF THE INVENTION

This invention generally relates to leg garments.

BACKGROUND

Leg garments are coverings for legs. One type of a leg garment is a pair of chaps. Chaps are often comprised of sturdy leather, and are a leg covering usually worn over a wearer's trousers. Unlike trousers, however, chaps are often not joined at the crotch. They are typically worn to protect the legs and undergarments of a wearer when riding a horse or a motorcycle and to protect the wearer's legs from scraping in the event of a fall or if the legs strike an object while riding. Keeping dust and dirt off of undergarments is another consideration for wearing chaps. Chaps may also be worn as an additional layer for warmth.

Each leg of motorcycle chaps may be cut from a single piece of leather, the leather cut narrowly to fit snugly on the wearer. Motorcycle chaps may completely encircle the leg. Chaps may be a pull-on garment, with each leg attached to a waistband, or the chaps may have zippers or other fastening systems on the leg. For example, chaps may have full-length zippers running along the leg from the upper thigh to the ankles.

Wearing chaps over a pair of trousers may create discomfort, be highly inconvenient at times, and are considered unstylish by many wearers. For example, in warmer climates and temperatures, wearing chaps over a separate pair of trousers such as jeans may create an extremely uncomfortable temperature level. Likewise, wearing chaps are quite often bulky, and the bulkiness may limit movement of the wearer both on and off a motorcycle or horse. Chaps may also create uneasiness and inconvenience in undressing when using bathroom facilities or otherwise.

Some of these problems are created by the wearer of chaps having an amount of material in the abdominal region which is double the typical amount of material in the abdominal area when wearing a single pair of trousers. Some of the problems are also created by an increase of material on the legs as well. Although most chaps do not have material in the crotch region, the legs of chaps often are connected through material in the abdominal region. This abdominal connection may create much of the inconvenience that wearers of chaps, particularly women, experience.

DETAILED DESCRIPTION

Figure 1:
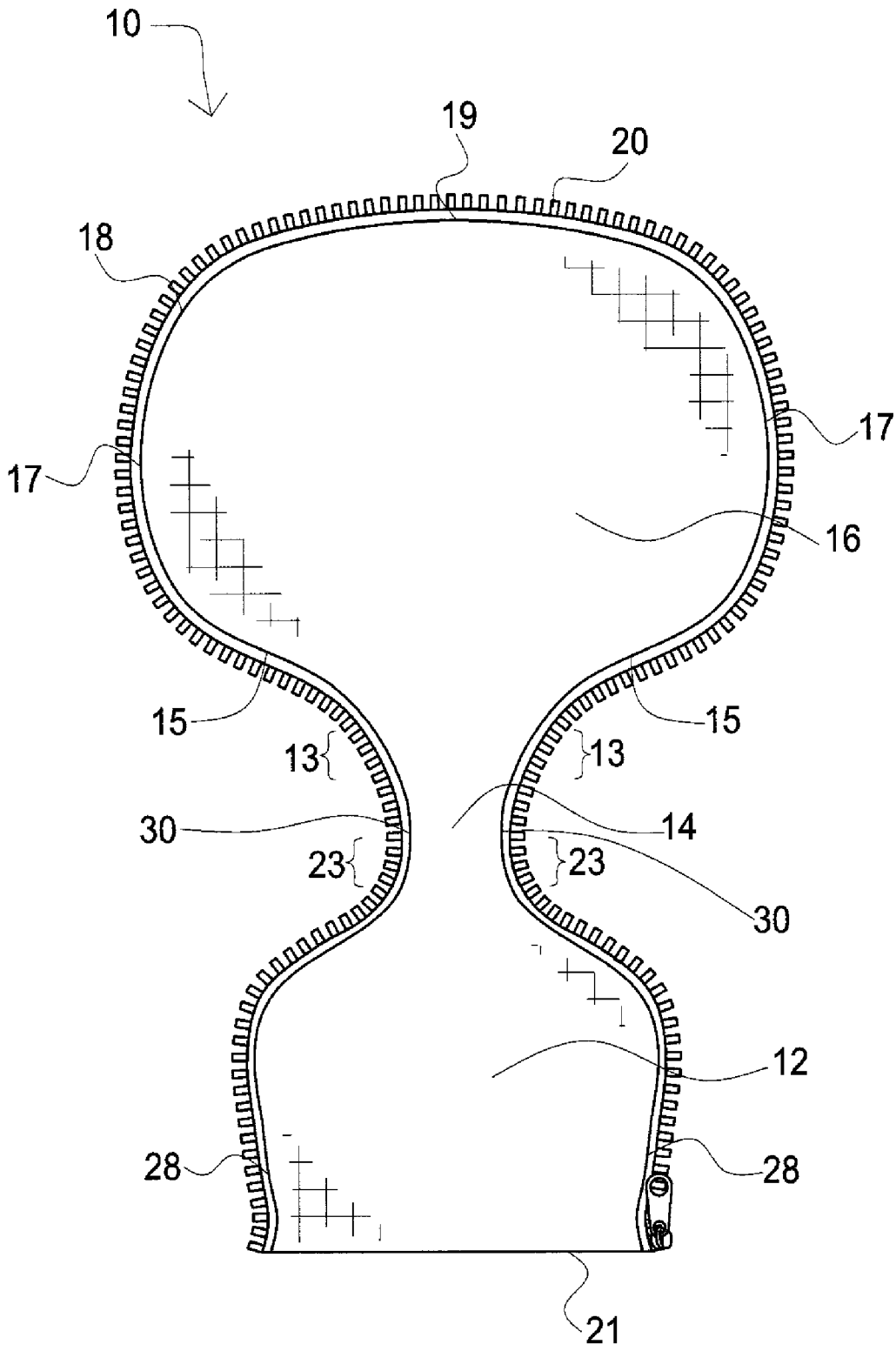
FIG. 1 is a top view of a leg garment insert laid flat according to one embodiment of the invention.

One embodiment of the invention is comprised of a leg garment having a leg garment insert wherein the insert is designed to alleviate the problems associated with wearing chaps or other similar leg garments, yet still provide an appearance of wearing leather chaps over a denim undergarment. In one embodiment, the insert is a denim crotch insert comprised of a single unitary material having an inseam portion, seat portion, and front portion. The insert may be designed as an attachment to leather chaps, where the insert may be easily attached and detached through a fastening system such as a zipper along the perimeter of the insert.

Having a denim crotch attachment to leather chaps may allow a person to receive the benefits of chaps without many of the detriments. For example, by wearing a leather leg garment which has a non-leather crotch insert, a wearer would still have the warmth and leg protection that is provided to wearers of chaps, but eliminates the need to wear an undergarment such as jeans or other trousers since the crotch area is already covered with a separate fabric. Therefore, the wearer's legs, crotch, and lower abdomen would still be kept cool in warmer temperatures. Additionally, such a garment would decrease the amount of material on a wearer, thereby decreasing the discomfort many chaps wearers experience, as well as decrease the inconvenience felt by many chaps wearers who are required to take extra time when dressing and undressing.

By coupling the leg garment insert to chaps, a separate and unique leg garment is created. In one embodiment, the insert attaches to a leg garment such as chaps which have a leg section and hip extensions. The hip extensions and leg section may be comprised of a single unitary material with the leg section substantially covering the legs and the hip extensions comprising strips of material extending vertically from the leg section upwardly from the thigh towards the waist. One version's hip extensions are located on the outsides of a person's hips when the person is wearing the garment. Additionally, the hip extensions and leg section may not be comprised of a single unitary material.

The garment insert may attach to the leg garment through a fastening system. The fastening system may be a first zipper part coupled to the perimeter of the insert which is adapted to couple to a correspondingly aligned second zipper part coupled to the leg section and hip extensions. Other fastening systems may be employed besides a zipper, such as, but not limited to, Velcro® hook and loop material. In a Velcro® embodiment, a Velcro® hook portion may be coupled to the perimeter of the insert, and the Velcro® loop portion may be coupled to the leg section and hip extensions.

The front portion of the garment insert may have a top edge which is generally even, or parallel, with a top edge of each hip extension. An embodiment may not have a parallel top hip extension edge. The hip extensions may also be comprised of two side edges, with a side edge portion being generally straight and parallel to each other in one embodiment. Other embodiments may have hip extension side edges which are curved. The front portion of the garment insert may also have two side edges which are generally perpendicular to the front portion top edge, with the front portion side edges coupling to the hip extension side edges through the fastening system.

The top edge of the front portion may couple to a waistband. The waistband may be integrated into the hip extensions. Therefore, in one embodiment, the waistband, hip extensions, and leg portion may be comprised of a single unitary fabric. In another embodiment, the hip extensions are not integrated to a waistband or the leg section.

In one embodiment, the front portion of the leg garment insert is integrated to an inseam portion. The inseam portion may have an hourglass shape. In one embodiment, as the side edges of the front portion extend away from the top edge of the front portion, and away from the wearer's lower abdomen towards the wearer's crotch, the side edges curve towards each other. At a point where the front portion side edges reach the lower crotch area on a person wearing the garment insert, the front portion side edges integrate to the inseam portion side edges. The inseam portion side edges may be coupled to the inner thigh of the leg portion, continuing to narrow towards each other. In one embodiment, the inseam side edges may have a generally parallel portion.

As the inseam portion extends toward a wearer's buttocks, after becoming narrower, the inseam portion becomes wider and the side edges open, or flare, away from each other. As the inseam portion reaches the wearer's buttocks when a wearing the garment insert, the inseam portion may be integrated to the seat portion, with the inseam portion side edges integrated to the seat portion bottom edges in one embodiment.

The seat portion bottom edges may extend outwardly from each other towards the hips of a wearer, integrating to seat portion side edges. The seat portion side edges may couple to an edge of the hip extension opposing the hip extension front edge. The seat portion may also couple to a waistband and in one embodiment a seat portion top edge couples to the waistband. The seat portion may also be of a generally oval shape, having one edge, the one edge coupling to the leg section, hip extensions and the waistband.

Terminology:

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, tense or any singular or plural variations of the defined word or phrase.

The term "or" as used in this specification and the appended claims is not meant to be exclusive rather the term is inclusive meaning "either or both".

References in the specification to "one embodiment", "an embodiment", "a preferred embodiment", "an alternative embodiment", "a variation", "one variation", and similar phrases mean that a particular feature, structure, or characteristic described in connection with the embodiment is included in at least an embodiment of the invention. The appearances of phrases like "in one embodiment", "in an embodiment", or "in a variation" in various places in the specification are not necessarily all meant to refer to the same embodiment or variation.

The term "couple" or "coupled" as used in this specification and the appended claims refers to either an indirect or direct connection between the identified elements, components or objects. Often the manner of the coupling will be related specifically to the manner in which the two coupled elements interact.

The term "integrate" or "integrated" as used in this specification and the appended claims refers to a blending, uniting, or incorporation of the identified elements, components or objects into a unified whole.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

As applicable, the terms "about" or "generally" as used herein unless otherwise indicated means a margin of +−20%. Also, as applicable, the term "substantially" as used herein unless otherwise indicated means a margin of +−10%. It is to be appreciated that not all uses of the above terms are quantifiable such that the referenced ranges can be applied.

Figure 2:
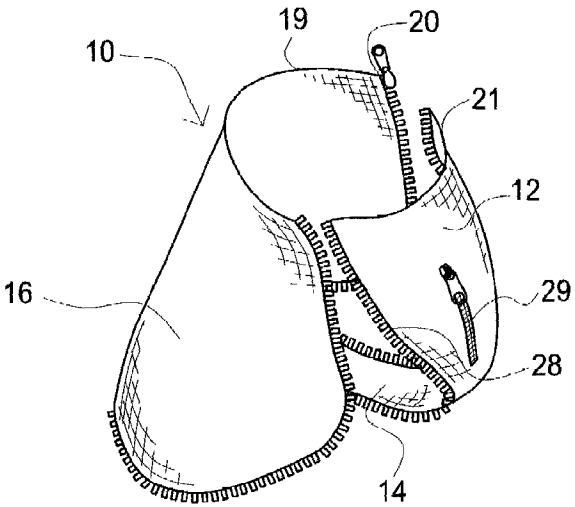
FIG. 2 is an isometric view of a leg garment insert in a position to accept a leg garment according to one embodiment of the invention.

One Embodiment of a Leg Garment:

As shown in FIGS. 1 & 2, an embodiment of a leg garment insert 10 is shown. The leg garment insert may be referred to as a leg garment first portion. One version of a leg garment insert has a front portion 12, an inseam portion 14, and a rear portion 16. As best shown in FIG. 1, the insert may be comprised of a single unitary material, covering a substantial portion of a wearer's genitals. The garment insert may also have coupled portions, such as, but not limited to, a garment insert front portion which is coupled to the inseam portion, which is integrated to the seat portion. The front portion may be adapted to be removed separately from the inseam portion. One type of material that may be used as a garment insert 10 is denim, however other materials that may be used are materials such as, but not limited to, a stretch material like Spandex®, or other material such as, but not limited to, leather.

One embodiment of a leg garment insert 10 is adapted to couple to a leg garment such as, but not limited to, a pair of chaps. Embodiments are contemplated where the garment insert is not coupled to a pair of chaps, but is coupled other leg garments such as, but not limited to, trousers and jeans. The insert is coupled to the leg garment through a fastening system 20. One embodiment's fastening system may be a zipper. In one embodiment, the fastening system is coupled to at least a portion of the perimeter of the garment insert, as best shown in FIG. 1.

Figure 3:
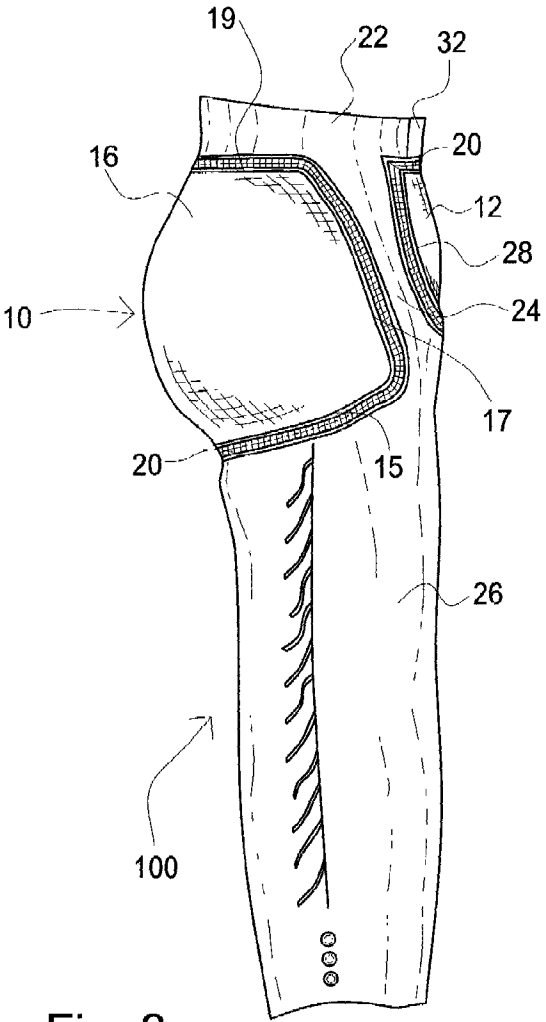
FIG. 3 is a side view of a leg garment with hip extensions and a waistband having a garment insert according to one embodiment of the invention.

The leg garment may include a waistband. However, a version is contemplated where the insert 10 is not adapted to couple to a leg garment which includes a waistband. As best shown in FIG. 3, the waistband 22 in one embodiment is integrated to a leg section 26 through at least one hip extension 24. In one embodiment, the garment insert is adapted to couple to a waistband, hip extension and the leg section, with the waistband, hip extension and leg section being comprised of a single unitary piece of material such as, but not limited to, leather. Additionally, in embodiments where the garment insert is adapted to couple to a leg garment which does not have a waistband, the hip extension and leg section may be integrated together and comprised of a single unitary material. A leg garment insert's seat portion 16 may be adapted to couple to the leg garment's waistband, hip extension, and leg section which are not integrated together, but are coupled together.

In one embodiment, as best shown in FIG. 1, the seat portion of the insert is comprised of a generally oval shape, with at least one outer edge 18. Operatively coupled to the outer edge may be the fastening system 20. As best shown in FIG. 2, in an embodiment having a seat portion top edge 19, the top edge may not be operatively coupled to the fastening system. Such an embodiment may be adapted to couple to a leg garment without a waistband.

The seat portion 16 of one embodiment may not be comprised of a generally oval shape, but may have a shape different from a generally oval shape. Whatever the shape of the seat portion, in one embodiment the fastening system 20 may be operatively coupled to the at least one outer edge 18. However, a fastening system is contemplated which is not coupled to the at least one outer edge of the seat portion. Such a fastening system may be a fastening system such as, but not limited to, buttons that are coupled to an outer surface of the seat portion or snaps that are coupled to an inner surface of the seat portion. Laces are also contemplated to couple the seat portion to the leg garment.

As best shown in FIG. 1, the fastening system 20 may be a single unitary fastening system generally extending along the outer edge 18 of the seat portion 16 to the outer edge 30 of the inseam portion 14. Another embodiment, as best shown in FIG. 2, may be comprised of a pair of fastening systems, with each fastening system coupled to and generally extending along a separate edge of the seat potion, inseam portion and front portion 12. Such an embodiment may or may not have a fastening system on the top edge 19 of the seat portion and a top edge 21 of the front portion. However, in one embodiment, a fastening system may couple to the seat portion and front portion top edges may be adapted to couple to a waistband.

Upon coupling the garment insert 10 to a leg garment, the seat portion 16 is adapted to generally cover the entire buttocks of a wearer. In one embodiment, the seat portion, when a wearer is wearing a leg garment with a coupled garment inert, extends from the wearer's left hip to the wearer's right hip and from the waist of the person to the top of the rear thighs, just below the buttocks. Other seat portions may have different dimensions, with one embodiment covering at least a portion of a wearer's right hip and left hip without extending from the waist to the thigh. In one embodiment where the seat portion has side edges 17, the side edges may be generally perpendicular to the seat portion's top edge 19. However, in one embodiment, the side edge may not be perpendicular to the top edge. As best shown in FIG. 1, the seat portion includes a pair of bottom edges 15, which may be integrated to the side edges, extending away and the side edges towards each other.

The inseam portion 14 may be integrated to the seat portion 16. One inseam portion is integrated at a point where, when wearing the leg garment insert coupled to a leg garment such as, but not limited to, chaps, the seat portion bottom edge 15 turns towards the front portion 12. This area is best shown in FIG. 1 as the seat-inseam integration area 13. The inseam portion may be generally hourglass shaped. An embodiment is contemplated where the inseam portion is not integrated to the seat portion and the front portion, but is coupled to each portion.

As the distance from the seat-inseam integration area 13 increases, and the distance to an inseam-front portion integration 23 decreases, the distance between the inseam side edges 30 begins to decrease. At a distance from the seat-inseam integration, the distance between the inseam side edges begins to increase. This distance may be at the point generally of equal distance from the inseam-front portion integration and the seat-inseam integration area 13. However, this point may be located at other distances as well.

As the distance between the inseam side edges 30 begins to increase, the rate that the distance between the side edges increases may be equal to the rate that the distance between the inseam side edges decreased when extending away from the seat-inseam integration area 13, creating a generally parabolic look to the outer edges of the inseam portion 14. However, in other embodiments, the inseam portion may have edges which are generally parallel for at least a portion of the edge length.

In one embodiment, the inseam side edges 30 are coupled to the fastening system 20. As best shown in FIG. 1, the fastening system may extend along the seat portion top edge 19, from the top edge to the side edges 17, and from the side edges to the bottom edges 15. The fastening system in one embodiment may also extend from the bottom edges 15 to the inseam side edges, and then from the inseam side edges to the front portion side edges 28 and front portion top edge 21.

The front portion side edges 28 may be generally perpendicular to the front portion top edge 21 at the point the front portion side edges integrate to the front portion top edge. As the distance from the front portion top edge increases, and the distance to the inseam-front portion integration 23 decreases, the distance between the front portion side edges 28 may decrease in one embodiment. The inseam portion is integrated to the front portion at the inseam-front portion integration 23. Generally, the front portion extends from a crotch area to the lower abdomen.

As best shown in FIG. 2, the front portion 12 of the garment insert may be comprised of a closable opening 29. The closable opening may be similar to the fly of a pair of trousers or jeans, such as a zipper, or may be a series of buttons such as buttons on "button-fly jeans". Other closable openings such as, but not limited to, laces are also contemplated.

Figures 4, 5, 6, 7:
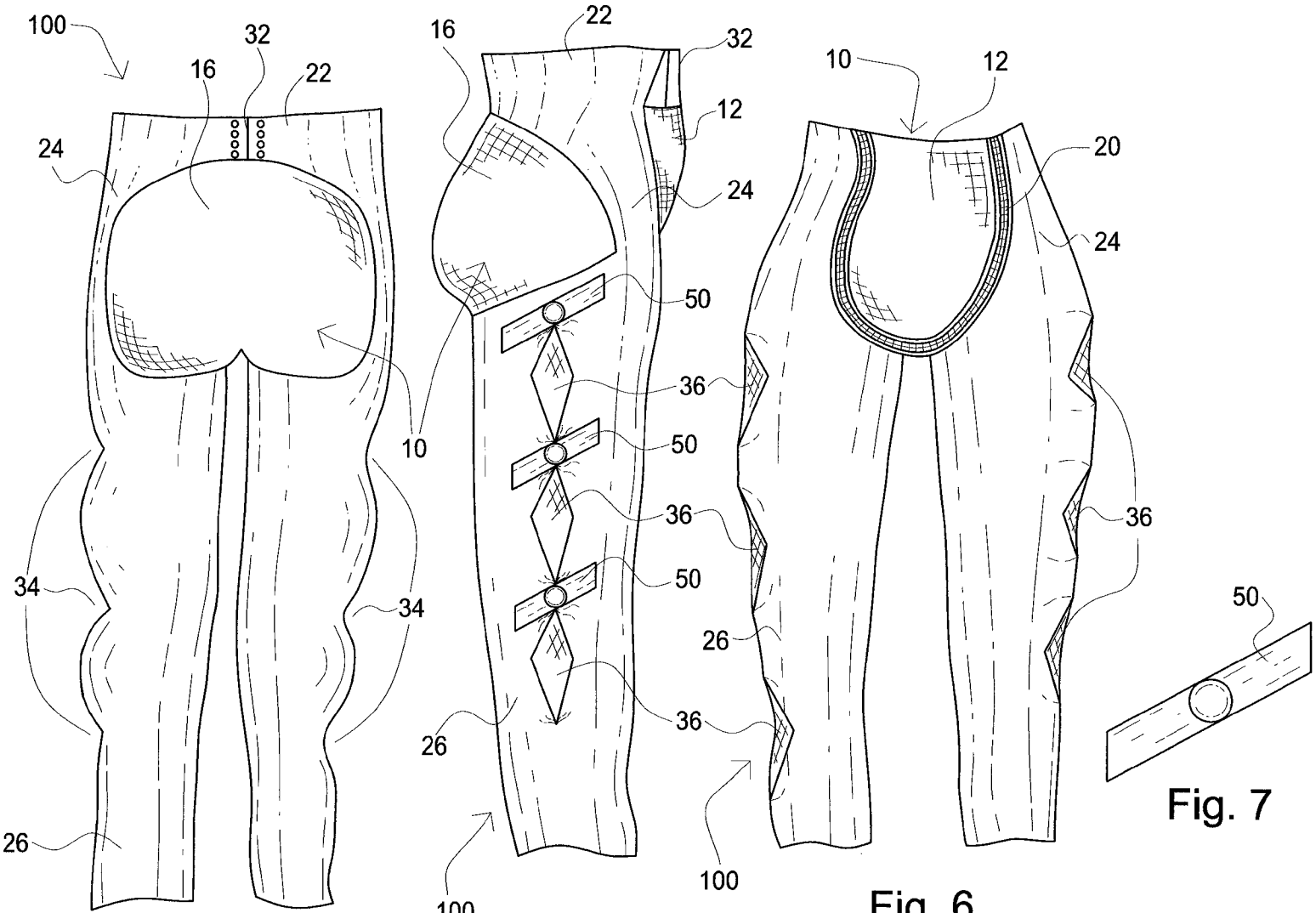
FIG. 4 is a rear view of a leg garment with hip extensions, a waistband, leg portion openings, and having a garment insert according to one embodiment of the invention.
FIG. 5 is a side view of a leg garment with hip extensions, a waistband, leg section parts, and having a garment insert according to one embodiment of the invention.
FIG. 6 is a front view of a leg garment with hip extensions, leg section parts, and having a garment insert according to one embodiment of the invention.
FIG. 7 is a front view of a leg garment accessory according to one embodiment of the invention.
Figure 8:
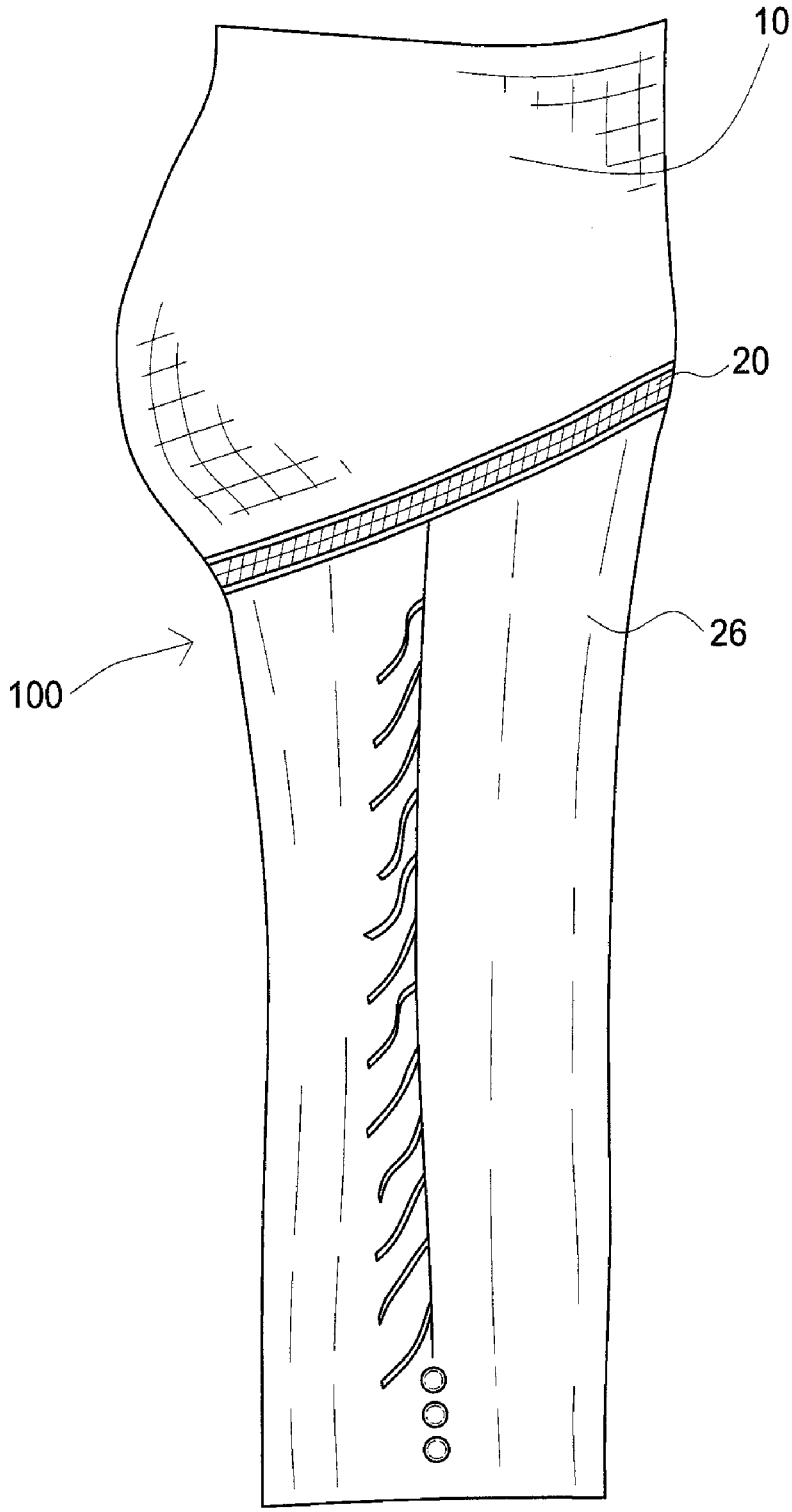
FIG. 8 is a side view of a leg garment without a waistband or hip extensions having a garment insert according to one embodiment of the invention.

As best shown in FIGS. 3 through 8, the leg garment insert 10 is coupled to a leg garment 100. As best shown in FIGS. 3 through 5, the leg garment may be comprised of a waistband 22, at least one hip extension 24, and a leg section 26, and may be referred to as a leg garment second portion. The leg garment insert 10 is an insert adapted to fit within the crotch area of the leg garment. As can be best shown by FIG. 6, the leg garment may not have a waistband, but may still have hip extensions. Also, as best shown by FIG. 8, the leg garment may have neither hip extensions nor a waistband.

The leg garment 100 with a garment insert 10 in one embodiment is designed to alleviate many of the problems that a wearer of chaps encounters. For example, the garment insert in one embodiment is comprised of a different material than the leg section 26, hip extensions 24, and waistband 22. One garment insert may be comprised of denim, and the leg section, hip extension and waistband may be comprised of leather, with the leg garment adapted to look like a person is wearing chaps over a pair of denim jeans, or trousers.

A leg garment 100 having a garment insert 10 may also allow a user to receive the benefits of chaps without the detriments of wearing chaps. For example, a wearer of chaps may wish to have the leg protection and the warmth that leather provides, but does not wish to wear a pair of chaps with or without an integrated leather crotch because of aesthetic reasons, because the leather crotch is uncomfortable, because the leather fabric does not breath as well as denim or another material, or for other considerations such as, but not limited to, inconvenience. The denim (or other material) insert, may therefore allow a user to protect his or her legs, provide the user with a different look than regular chaps, and provide other benefits such as easier undressing and dressing.

As can be best shown in FIG. 3, the garment insert 10 of one embodiment is coupled to the leg garment waistband 22, hip extension 24, and leg section 26. The garment insert may be comprised of a single unitary fabric. Similarly, the waistband, hip extensions and leg section may also be comprised of a single unitary fabric. The garment insert may be coupled through a fastening system 20. The fastening system, as best shown in FIGS. 3, 6 and 8, may be a zipper. Other fastening systems are contemplated.

As best shown in FIG. 3, the garment insert 10 has a seat portion 16 which is generally adapted to cover the buttocks of a wearer. The seat portion may be larger than the front portion 12, generally covering an area greater than the front portion. Other garment inserts may have seat portions which do not cover the entire buttocks. For example, the garment insert shown in FIG. 4 does not cover the portion of the buttocks located near a wearer's waist and hips.

The fastening system 20 may couple the perimeter of the seat portion to the hip extension 24, waistband 22 and an inner thigh of the leg section 26. Therefore, an embodiment may have a fastening system which is coupled to the perimeter of the garment insert. The fastening system may allow a wearer to easily remove the insert and replace it with a different style insert having a different fabric or print. The seat portion may only be coupled to the leg section in one embodiment, as best shown in FIG. 8. In an embodiment with a waistband, the seat portion may not couple to the waistband.

One fastening system 20 may be comprised of two parts. In one two-part fastening system, a first part may be coupled to a garment insert perimeter. A second part may be coupled to the leg section 26. One embodiment's second part may also be coupled to the hip extension 24 and the waistband 22.

The waistband 22 of the leg garment 100 may provide support, utility, and aesthetic appeal. The waistband may include a clasping device 32 on the front of the waistband. A clasping device 32 may even be included in the rear of the waistband, as best shown in FIG. 4. The clasps may provide support and utility by enabling a user to open the clasps in order to remove the leg garment. When wearing the leg garment, the clasps may be closed to ensure the leg garment is kept above a wearer's hips. The waistband may couple to the seat portion top edge 19.

The leg garment's hip extensions 24 also provide aesthetic appeal and utility support. As shown by FIGS. 3 and 5, the hip extensions may have different shapes, allowing wearers to choose different styles. The hip extensions also keep the leg section 26 of the leg garment from falling around a wearer's ankles. This is done by the hip extension being integrated (or, in another embodiment, coupled) to the waistband 22 and the leg section. As the waistband is secured above a user's hips through the clasp, the hip extension keeps the leg section from falling down.

The hip extension 24 also plays a role in reducing the problems associated with wearing chaps over a pair of trousers. In coupling to the front portion 16 of the garment insert through the fastening system 20, the hip extension reduces the amount of material which is typically placed around a chap wearer's mid-section as there is no extra material under the hip extensions. In this way, the leg garment 100 is more comfortable to wear, and it makes it easier to dress and undress. The leg garment may also create a greater freedom of movement.

In an embodiment where the hip extensions 24 are not coupled to a waistband 22, a top portion of the hip extensions may have an elastic material, or may have hoops to enable a belt to encircle the leg garment. Embodiments having waistbands may also enable belts to encircle the waist in order to keep the leg garment from falling down or may have an elastic portion as well. Also, a top section of the front portion 12 and seat portion 16 may have an elastic material or may have hoops adapted to receive a belt.

Upon coupling the garment insert 10 to the leg garment 100, the hip extensions 24 in one embodiment extend between the front portion 12 and the seat portion 16. An embodiment's hip extension may have a hip extension front edge which is coupled to the front portion. A hip extension may have a hip extension rear edge which may oppose the front edge and couple to the seat portion.

The leg section 26 may also be coupled to the garment insert 10. In one embodiment, the leg section is integrated to the garment insert. The hip extensions 24 or waistband 22 may also be integrated to the insert in an embodiment. The leg section may also have ornamental tassels 50, as best shown in FIG. 7, which may be coupled longitudinally down the outside of a leg, as best shown in FIG. 5.

Additionally, the leg section may have a leg portion opening 34 on the outside of the leg section where the fabric is missing, as best shown in FIG. 4. In this type of embodiment, there are patches on each leg which do not include fabric. Also, as best shown in FIGS. 5 and 6, leg section parts 36 of the may have material which is a different material than the rest of the leg section. One embodiment's leg section completely encircles the leg.

OTHER EMBODIMENTS AND VARIATIONS

The embodiments of the leg garment as illustrated in the accompanying figures and described above are merely exemplary and are not meant to limit the scope of the invention. It is to be appreciated that numerous variations to the invention have been contemplated as would be obvious to one of ordinary skill in the art with the benefit of this disclosure. For example, the chaps may have more than one hip extension 24, such as, but not limited to, a pair of chaps with two hip extensions on each hip.

I claim:

1. A leg garment, the leg garment being adapted to (i) being worn on lower torso and legs of a wearer, and (ii) not cover an upper torso of the wearer, and comprising:

two leg sections, the two leg sections being coupled to each other and adapted to substantially enclose the legs of the wearer and to not cover a substantial area of buttocks, crotch, and lower abdomen of the wearer;

a garment insert, the garment insert including a seat portion adapted to cover the substantial portion of the buttocks of the wearer and an inseam-front portion adapted to cover the crotch and the lower abdomen of the wearer;

a fastening system, the fastening system removably coupling the garment insert to the leg sections; and a waist band, the waist band being adapted to encircle the lower torso of the user proximate a waist of the user; and hip extensions, the hip extensions being coupled to the waist band and to the two leg sections, and the hip extensions extending from the two leg sections to the waist band, wherein the waist band, the hip extensions, and the two leg sections circumscribe an area void of material, the area void of material having a size and shape that are the same as a size and shape of the garment insert.

2. The leg garment of claim 1, wherein the seat portion and the inseam-front portion form a single unit.

3. The leg garment of claim 1, wherein the garment insert comprises an outside edge and a zipper, the outside edge completely circumnavigating the garment insert and the zipper extending along the entire outside edge of the garment insert.

4. The leg garment of claim 1, wherein the garment insert further comprises a closable opening.

5. The leg garment of claim 4, wherein the closeable opening is a fly.

6. The leg garment of claim 1, wherein the leg sections comprise leather and the garment insert further comprises breathable fabric.

7. The leg garment of claim 6, wherein the breathable fabric is denim.

8. A leg garment, the leg garment being adapted to (i) being worn on lower torso and legs of a wearer, and (ii) not cover an upper torso of the wearer, and comprising:

chaps having two leg sections, the two leg sections being coupled to each other and adapted to substantially enclose the legs of the wearer and to not cover a substantial portion of buttocks, crotch, and lower abdomen of the wearer;

a garment insert, the garment insert including a seat portion adapted to cover the substantial portion of the buttocks of the wearer and an inseam-front portion adapted to cover the crotch and the lower abdomen of the wearer;

a waist band, the waist band being adapted to encircle the lower torso of the user proximate a waist of the user;

hip extensions, the hip extensions being coupled to the waist band and to the two leg sections, and the hip extensions extending from the two leg sections to the waist band;

wherein the waist band, the hip extensions, and the two leg sections circumscribe an area void of material, the area void of material having a size and shape that are the same as a size and shape of the garment insert; and wherein the garment insert comprises an outside edge and a zipper, the outside edge completely circumnavigating the garment insert and the zipper extending along the entire outside edge of the garment insert.

* * * * *